US011555339B2

(12) United States Patent
Tamura et al.

(10) Patent No.: US 11,555,339 B2
(45) Date of Patent: Jan. 17, 2023

(54) LOCK DEVICE

(71) Applicant: MITSUI KINZOKU ACT CORPORATION, Yokohama (JP)

(72) Inventors: Shunsuke Tamura, Yokohama (JP); Toshio Takenaka, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 574 days.

(21) Appl. No.: 15/539,383

(22) PCT Filed: Dec. 24, 2014

(86) PCT No.: PCT/JP2014/084096
§ 371 (c)(1),
(2) Date: Jun. 23, 2017

(87) PCT Pub. No.: WO2016/103353
PCT Pub. Date: Jun. 30, 2016

(65) Prior Publication Data

US 2017/0350172 A1 Dec. 7, 2017

(51) Int. Cl.
*E05B 83/26* (2014.01)
*E05B 81/34* (2014.01)
(Continued)

(52) U.S. Cl.
CPC ..... *E05B 83/26* (2013.01); *E05B 79/20* (2013.01); *E05B 79/22* (2013.01); *E05B 81/06* (2013.01);
(Continued)

(58) Field of Classification Search
CPC ..... E05B 83/26; E05B 79/20; E05B 79/22; E05B 81/06; E05B 81/14; E05B 81/34;
(Continued)

(56) References Cited

U.S. PATENT DOCUMENTS 4,080,812 A * 3/1978 Knott ..... E05B 83/16 292/DIG. 43
6,048,002 A * 4/2000 Ohta ..... E05B 81/20 292/201

(Continued)

FOREIGN PATENT DOCUMENTS

CN 1676845 A 10/2005
CN 103174342 A 6/2013

(Continued)

OTHER PUBLICATIONS

International Search Report for PCT/JP2014/084096 dated Mar. 24, 2015.

(Continued)

*Primary Examiner* — Christine M Mills
*Assistant Examiner* — Faria F Ahmad
(74) *Attorney, Agent, or Firm* — Foley & Lardner LLP

(57) ABSTRACT

A lock device 1 includes a latch 10 that locks a striker 2, a ratchet 11 that is brought into engagement with the latch 10 to prevent the movement of the latch 10, a lever 12 that moves the ratchet 11 to a releasing position where the ratchet 11 releases the latch 10, an actuator 13 that includes a motor 23 that operates the lever 12, a base 14 that supports the latch 10, the ratchet 11, the lever 12 and the actuator 13, and a case 15 that is fixed to the base 14 and accommodates at least the actuator 13 between the base 14 and the case 15, and an attaching portion 44, to which an operating member 16 that is connected to the lever 12 so as to enable the lever 12 to be operated manually is attachable, is provided integrally on the case 15.

14 Claims, 11 Drawing Sheets

(51) Int. Cl.

| | |
|---|---|
| ***E05B 81/42*** | (2014.01) |
| ***E05B 81/14*** | (2014.01) |
| ***E05B 79/22*** | (2014.01) |
| ***E05B 83/18*** | (2014.01) |
| ***E05B 79/20*** | (2014.01) |
| ***E05B 81/06*** | (2014.01) |

(52) U.S. Cl.
CPC ..... *E05B 81/14* (2013.01); *E05B 81/34* (2013.01); *E05B 81/42* (2013.01); *E05B 83/18* (2013.01); *Y10S 292/30* (2013.01); *Y10S 292/42* (2013.01); *Y10T 292/57* (2015.04)

(58) Field of Classification Search
CPC ..... E05B 81/42; E05B 83/18; Y10T 292/57; Y10S 292/03; Y10S 292/42
USPC ..... 292/DIG. 30, DIG. 42
See application file for complete search history.

(56) References Cited

U.S. PATENT DOCUMENTS 6,086,131 A * 7/2000 Bingle ..... E05B 83/26 292/336.3
6,135,514 A * 10/2000 Kowalewski ..... E05B 83/16 292/216
6,193,301 B1 * 2/2001 Baumeier ..... B60J 7/1851 292/DIG. 4
6,369,395 B1 * 4/2002 Roessler ..... E05B 83/16 250/462.1
6,394,511 B1 * 5/2002 Lam ..... E05B 83/16 292/336.3
6,527,313 B2 * 3/2003 Takahashi ..... E05B 83/26 292/336.3
6,598,436 B2 * 7/2003 Ponn ..... E05B 79/20 292/201
7,192,066 B2 * 3/2007 Ilea ..... E05B 81/25 292/201
7,766,397 B2 * 8/2010 Carabalona ..... E05B 81/14 292/201
8,317,237 B1 * 11/2012 Fannon ..... E05B 79/20 292/336.3
8,783,738 B2 * 7/2014 Watanabe ..... E05B 85/26 292/201
8,833,811 B2 * 9/2014 Ishikawa ..... E05B 17/106 292/336.3
9,593,513 B2 * 3/2017 Higgins ..... E05B 83/26
10,808,434 B2 * 10/2020 Zia ..... E05B 79/20
2004/0163487 A1 * 8/2004 Martus ..... F16C 1/14 74/502.2
2005/0077734 A1 4/2005 Lim
2005/0099021 A1 * 5/2005 Jinzu ..... E05B 83/26 292/336.3
2005/0156436 A1 7/2005 Ju et al.
2012/0032456 A1 * 2/2012 Ishikawa ..... E05B 85/10 292/336.3
2018/0038140 A1 * 2/2018 McCarthy ..... B60J 5/0413
2018/0043801 A1 * 2/2018 Lambertz ..... E05B 81/16
2018/0058116 A1 * 3/2018 Erices ..... E05B 79/20
2018/0066457 A1 * 3/2018 Erices ..... E05B 81/14
2018/0094460 A1 * 4/2018 Kimura ..... E05B 81/16
2019/0106914 A1 * 4/2019 Tamura ..... E05B 83/18

FOREIGN PATENT DOCUMENTS

JP 2011-048429 A 3/2011
JP 4754349 B2 8/2011

OTHER PUBLICATIONS

Written Opinion of the International Search Authority for PCT/JP2014/084096 dated Mar. 24, 2015.
Chinese Office Action dated Sep. 5, 2018 in corresponding application No. 201480084205.0.

* cited by examiner

[FIG.10]
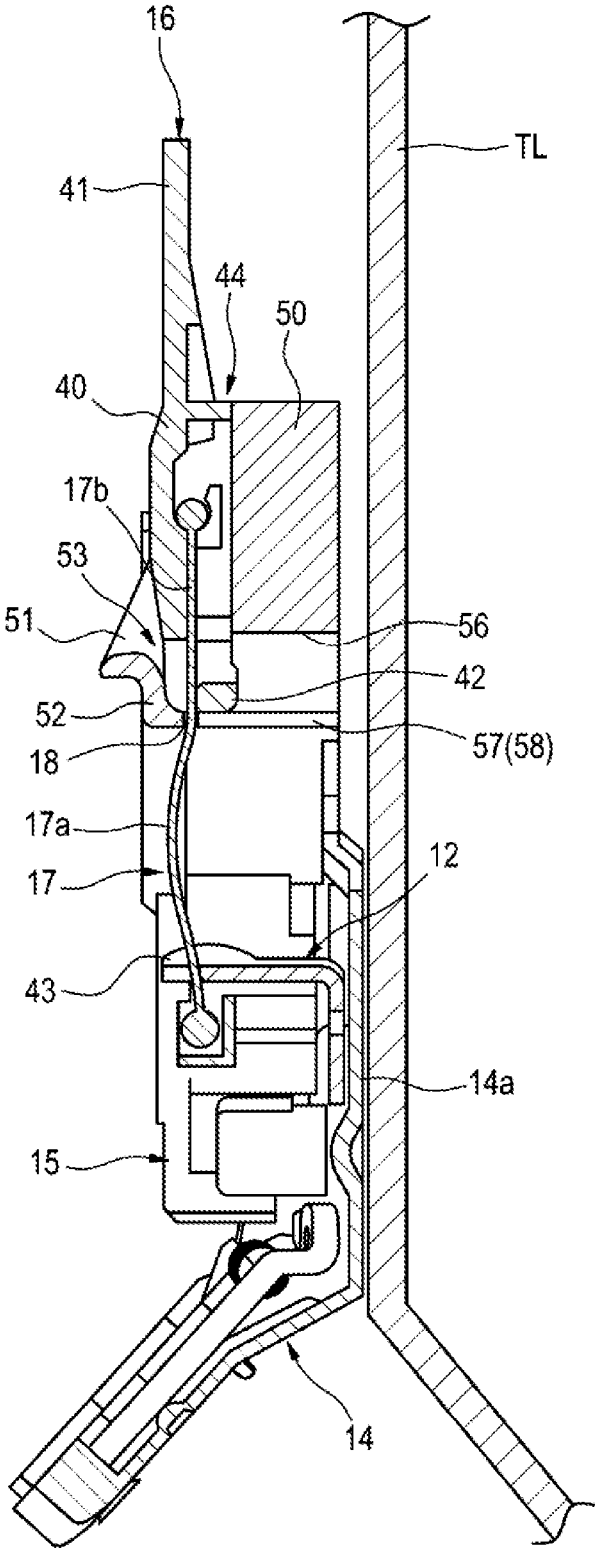

[FIG.11]
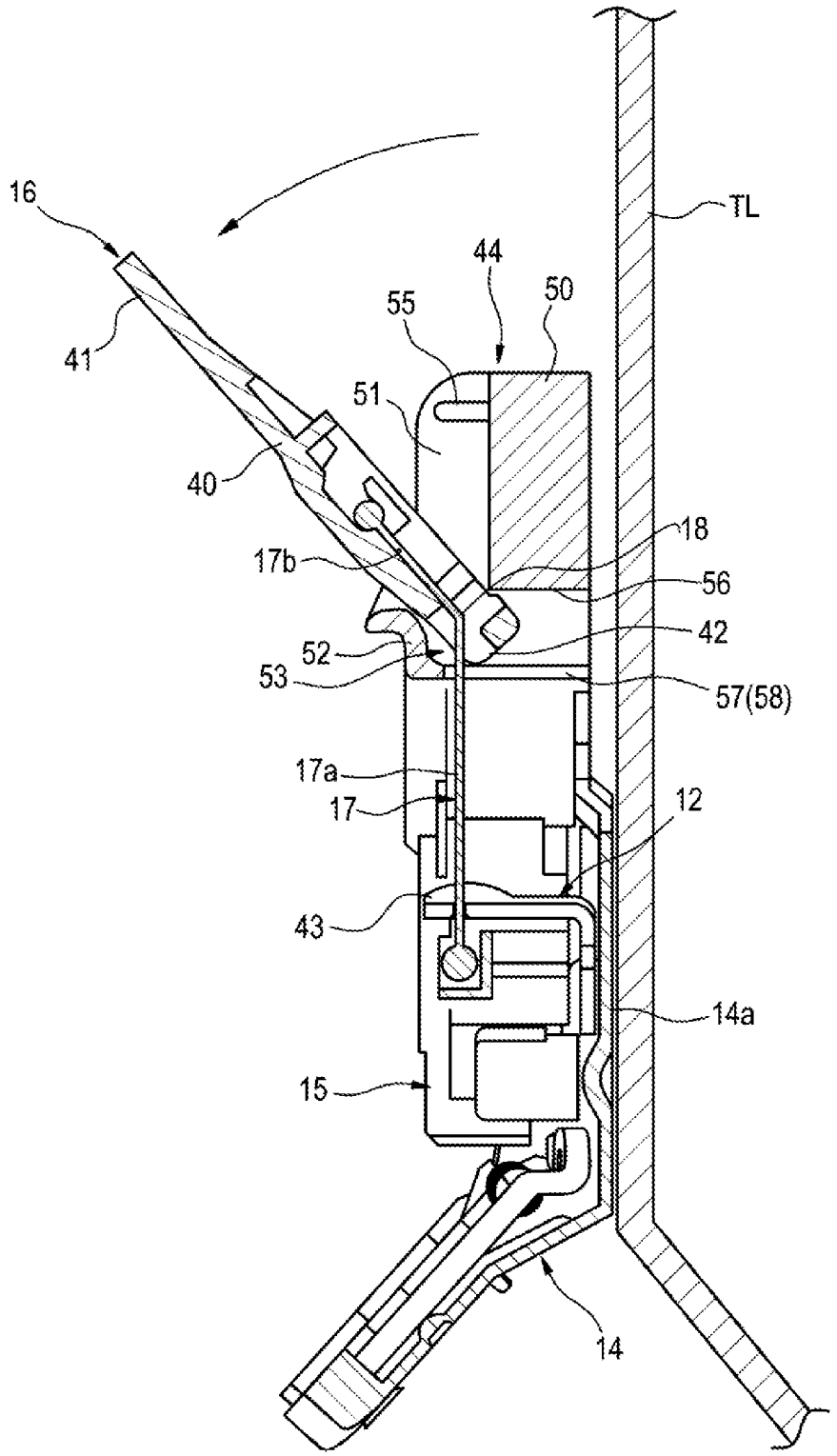

LOCK DEVICE

TECHNICAL FIELD

The present invention relates to a lock device.

BACKGROUND ART

A lock device which locks a trunk lid of a vehicle such as a motor vehicle is generally located on the trunk lid and includes a latch which locks a striker provided on a vehicle body, a ratchet which locks the latch so as to hold the locking of the striker by the latch, and a lever which brings the ratchet which locks the latch into operation so as to release the latch. The latch, ratchet and lever are supported on a metallic base. Additionally, a lock device is also known in which a lever is brought into operation by an actuator including a motor.

In general, a control switch of the actuator is provided inside a passenger compartment, so that the switch cannot be operated from the inside of a trunk. Thus, there is also known a lock device in which a release lever is brought into operation by an actuator, and in this lock device, an emergency handle (hereinafter, referred to simply as a handle) is separately provided with which the lever can be operated from the inside the trunk.

In this type of lock device, for example, regulations in various countries require a handle to be provided on the lock device, and in the event of the handle being provided on the lock device, for example, a metallic handle housing where the handle is detachably attached is welded to a base. Additionally, in lock devices described in PTLs 1 and 2, an attaching portion where a handle housing can be attached is provided integrally on a base in advance. The handle housing has a locking claw which is brought into engagement with the attaching portion on the base, and the handle housing is attached to the base by the locking claw being brought into engagement with the attaching portion.

CITATION LIST

Patent Literature

PTL 1: Japanese Patent Publication No. 4754349
PTL 2: JP-A-2011-48429

SUMMARY OF INVENTION

Technical Problem

Welding the metallic handle housing to the base as required increases the number of man-hours and cost required to build up the lock device. As in the lock devices described in PTLs 1 and 2, in the event that the attaching portion where the handle housing can be attached is provided integrally on the base in advance and that the locking claw is brought into engagement with the attaching portion so that the handle housing is attached to the base, the number of man-hours and cost can be reduced. On the other hand, the attachment of the handle housing to the base by means of the engagement of the locking claw with the attaching portion is inferior in strength to the attachment through welding, resulting fears that the handle housing is dislocated by impact produced when the trunk lid is closed.

The invention has been made in view of the situations described above, and an object thereof is to provide a lock device which has superior reliability and which can reduce the number of man-hours and cost required to build up the lock device itself.

Solution to Problem

A lock device according to one aspect of the present invention comprises: a latch that is movable between a locking position where the latch locks a striker and an unlocking position; a ratchet that is movable between an engaging position where the ratchet is brought into engagement with the latch which is moved to the locking position to prevent the latch from moving to the unlocking position and a releasing position where the ratchet releases the latch; a lever configured to move the ratchet to the releasing position; an actuator comprising a motor for operating the lever; a base that supports the latch, the ratchet, the lever and the actuator; and a case, which is fixed to the base, and which accommodates at least the actuator between the base and the case, wherein an attaching portion, to which an operating member is attachable, is provided integrally on the case, the operating member being connected to the lever so as to enable the lever to be operated manually.

Advantageous Effects of Invention

According to the invention, it is possible to provide the lock device which has superior reliability and which can reduce the number of man-hours and cost required to build up the lock device itself.

BRIEF DESCRIPTION OF DRAWINGS

FIG. 10 A diagram showing a section taken along a line X-X in FIG. 9.

FIG. 11 A diagram showing the operation of the handle of the lock device shown in FIG. 1 when the handle is operated.

DESCRIPTION OF EMBODIMENTS

Figure 1:
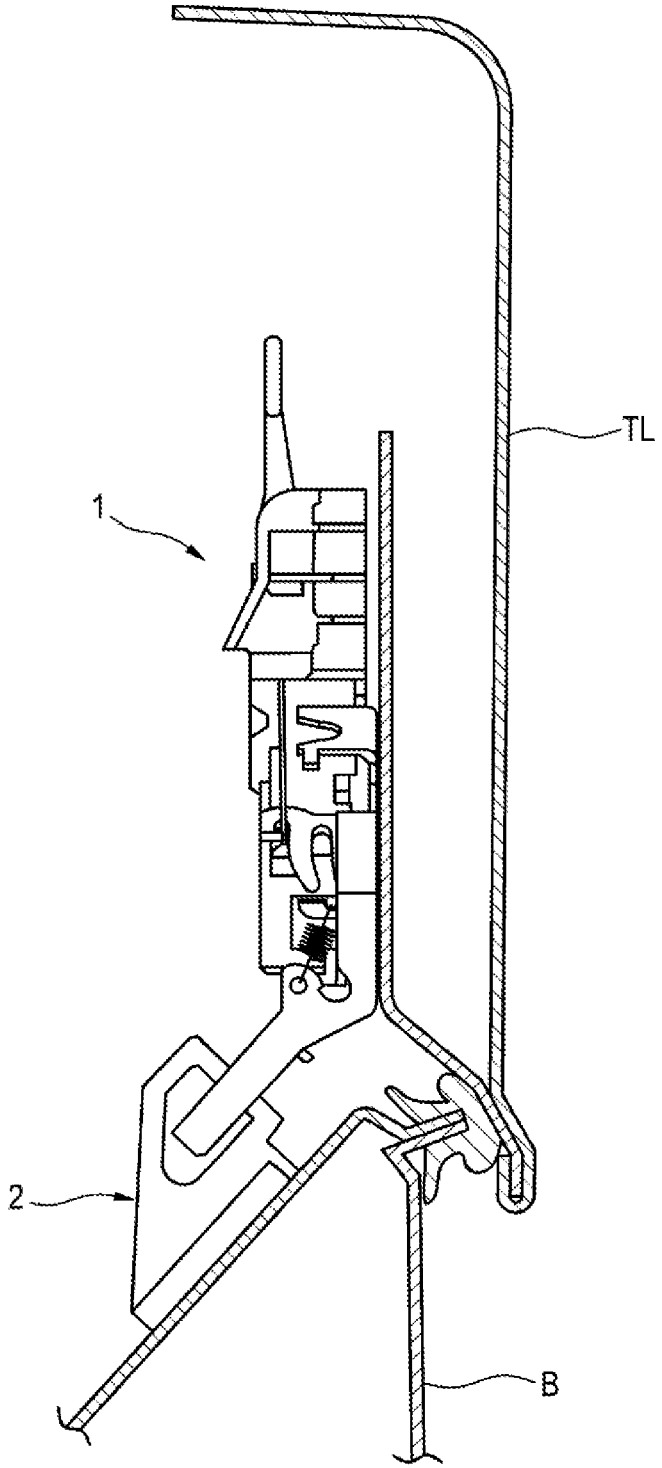
FIG. 1 A diagram showing an example of a lock device to describe an embodiment of the invention.

FIG. 1 shows the configuration of an example of a lock device to describe an embodiment of the invention.

A lock device 1 is a lock device which locks a trunk lid of a vehicle. The lock device 1 is placed on a trunk lid TL and locks a striker 2 which is provided on a vehicle body B to lock the trunk lid TL.

Figure 2:
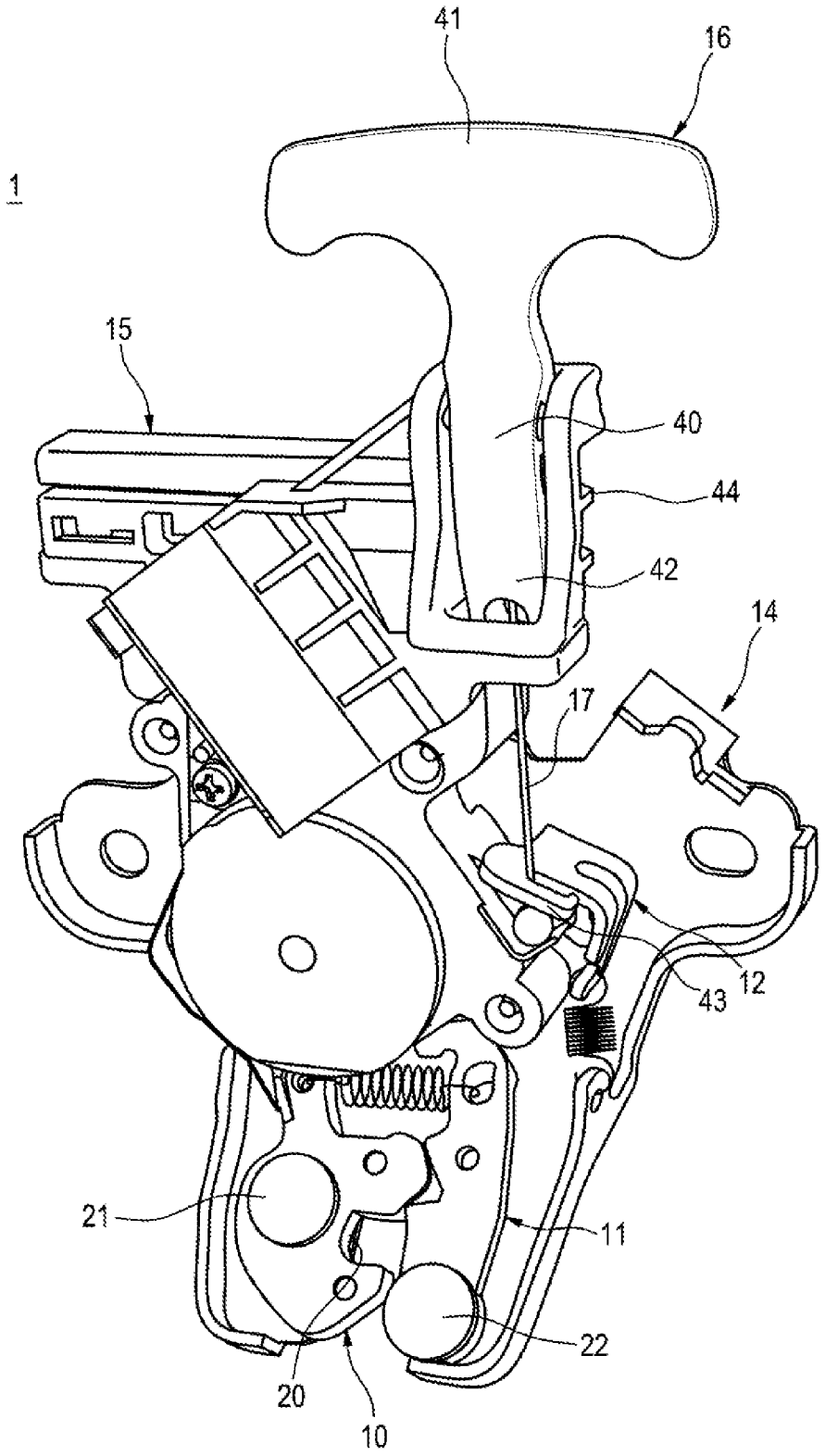
FIG. 2 A front perspective view showing the configuration of a locking portion of the lock device shown in FIG. 1.
Figure 3:
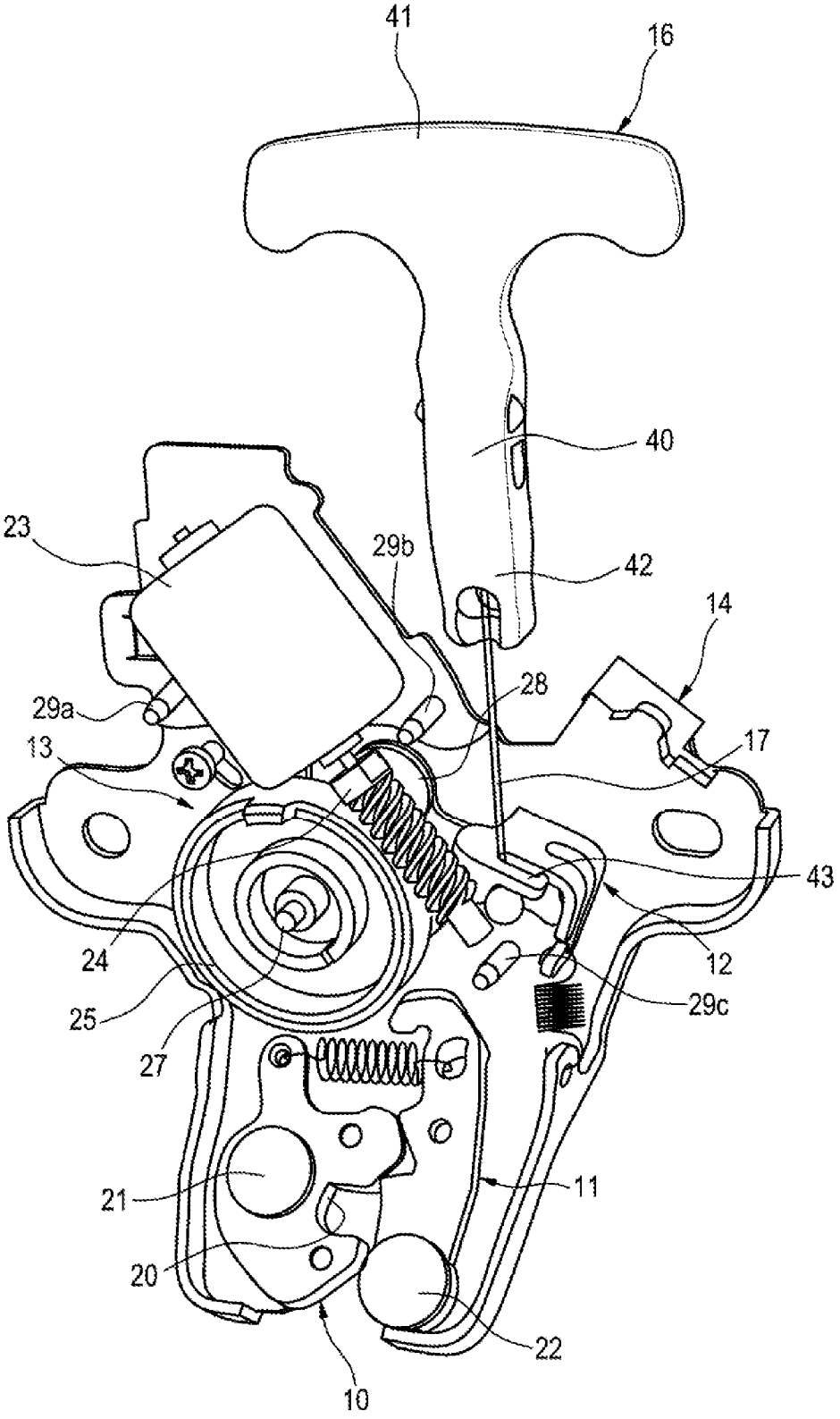
FIG. 3 A front perspective view showing the configuration of an interior of an actuator of the lock device shown in FIG. 1.
Figure 4:
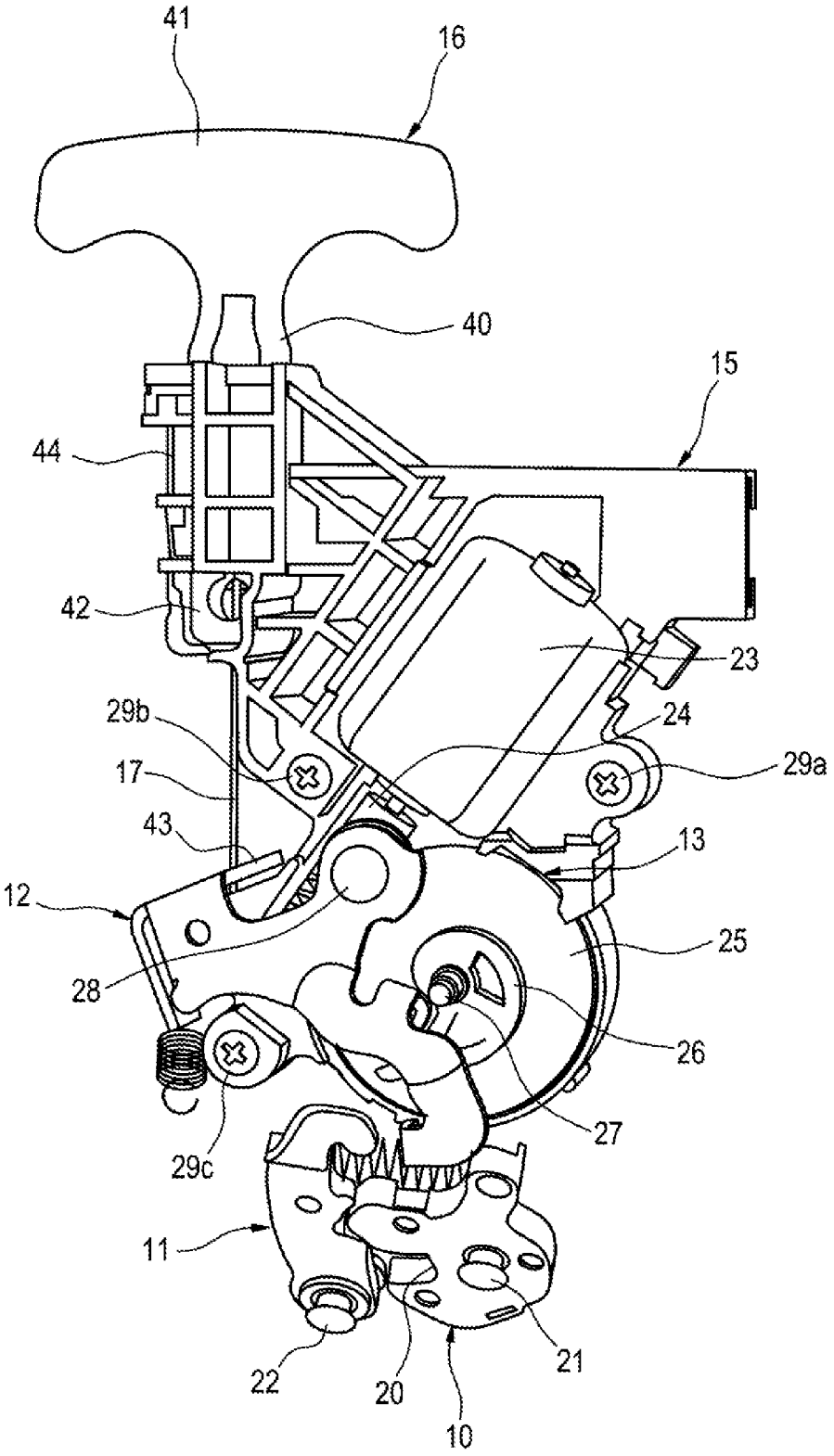
FIG. 4 A rear perspective view showing the configuration of the interior of the actuator of the lock device shown in FIG. 1.

FIG. 2 shows the configuration of a locking portion of the lock device 1, and FIGS. 3 and 4 show the configuration of an interior of an actuator of the lock device 1.

The lock device 1 includes a latch 10 which locks the striker 2 (refer to FIG. 1), a ratchet 11 which locks the latch 10 to hold the locking of the striker 2 by the latch 10, a lever 12 which brings the ratchet 11 which locks the latch 10 into operation to release the latch 10, an actuator 13 which brings the lever 12 into operation, a base 14 which supports thereon the latch 10, the ratchet 11, the lever 12 and the actuator 13, and a case 15. It is noted that the case 15 is omitted in FIG. 3, while the base 14 is omitted in FIG. 4.

The latch 10 has a locking groove 20 which the striker 2 can enter and is moved between an unlocking position where the striker 2 can enter the locking groove 20 and a locking position where the striker 2 which enters the locking groove 20 is prevented from being dislocated from the locking groove 20.

The ratchet 11 is moved between an engaging position where the latch 10 which has been moved to the locking position is locked to prevent the latch 10 from moving to the unlocking position and a releasing position where the latch 10 is released.

The movement of the latch 10 between the locking position and the unlocking position and the movement of the ratchet 11 between the engaging position and the releasing position are both a rotational movement. A pin 21, which configures a rotational shaft around which the latch 10 rotates, and a pin 22, which configures a rotational shaft around which the ratchet 11 rotates, are supported by the base 14.

The actuator 13 includes a motor 23, and a worm 24 and a worm wheel 25 which transmit the power of the motor 23 to the lever 12. The worm 24 is fixed to an output shaft of the motor 23, and the worm wheel 25 which meshes with the worm 24 is rotated in association with the rotation of the worm 24.

A cam 26 is provided on the worm wheel 25, and this cam 26 is brought into sliding contact with the lever 12, and the lever 12 is rotated by the cam 26 which is caused to slide in association with the rotation of the worm wheel 25. The lever 12 which is so rotated presses against the ratchet 11, and the ratchet 11 which is pressed against by the lever 12 is moved from the engaging position to the releasing position.

A pin 27, which configures a rotational shaft of the cam 26 and the worm wheel 25, and a pin 28, which configures a rotational shaft of the lever 12, are supported on the base 14.

The case 15 covers partially the actuator 13 and the lever 12 to accommodate the actuator 13 and the lever 12 partially between the base 14 and itself and is fixed to the base 14. In the example illustrated, the case 15 is fastened to the base 14 at three locations by means of screws 29*a*, 29*b*, 29*c*.

The base 14 is formed of a plate material made of metallic material such as steel, and the case 15 is formed from a resin material.

The lock device 1 includes further a control member which enables the lever 12 which moves the ratchet 11 from the engaging position to the releasing position to be operated manually. In this example, the control member is a handle 16 which is pulled.

The handle 16 has a shaft 40 which extends in a direction in which the handle 16 is pulled and a grip portion 41 which is provided at a distal end portion of the shaft 40. A proximal end portion 42 of the shaft 40 is connected to a connecting portion 43 of the lever 12 which is disposed so as to be exposed from the case 15 via a wire 17.

Then, an attaching portion 44 is provided integrally on the case 15 so that the handle 16 is detachably attached thereto, and the handle 16 is attached to the attaching portion 44.

Hereinafter, referring to FIGS. 5 to 9, the operation of the lock device 1 will be described.

A cutout 30, which regulates a direction in which the striker 2 enters the locking groove 20 in the latch 10, is provided on the base 14. The cutout 30 is formed so as to extend substantially into a linear shape from one edge of the base 14. The striker 2 is moved in a direction indicated by an arrow A along the cutout 30 as the trunk lid TL is operated to be closed, whereby the striker 2 enters the locking groove 20.

Figure 5:
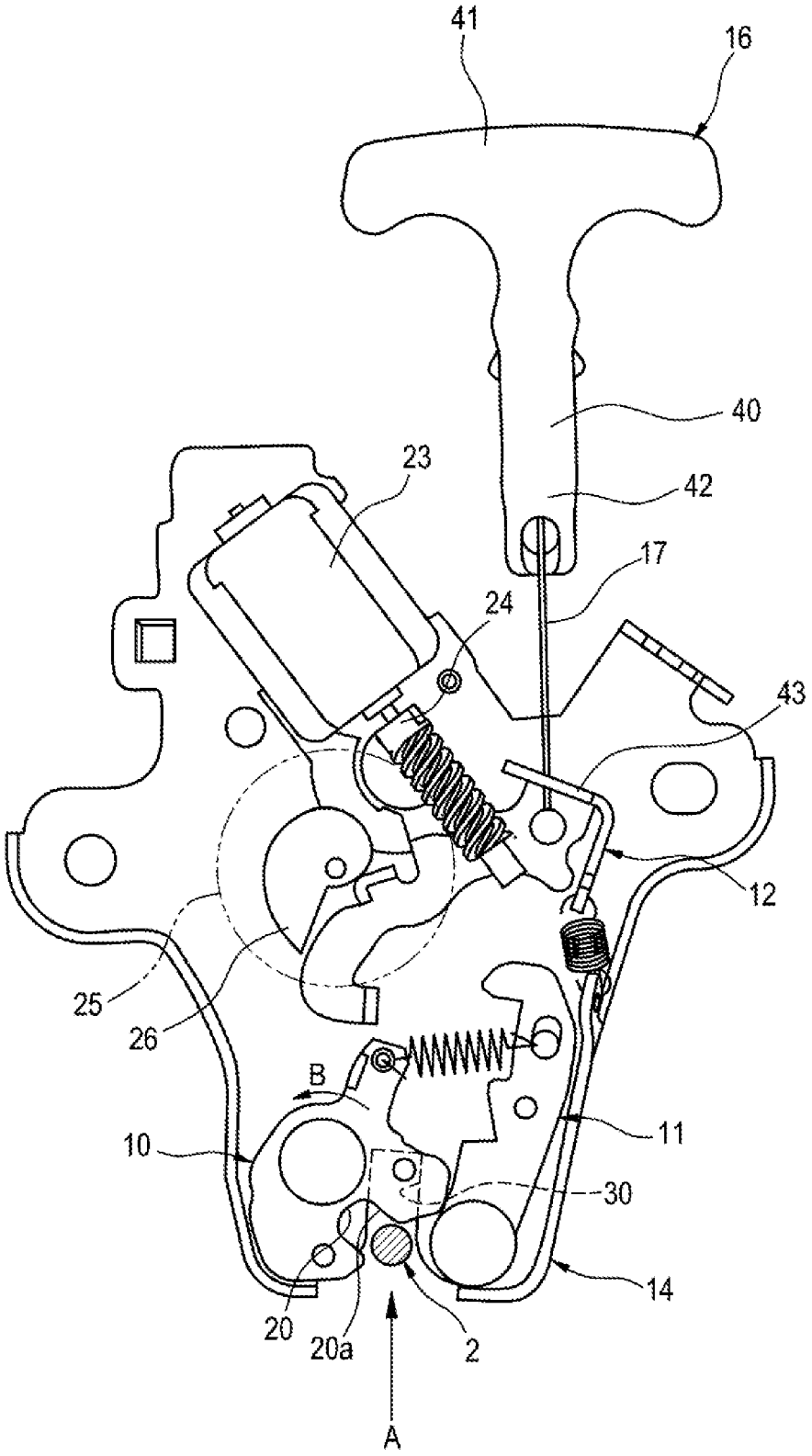
FIG. 5 A diagram showing an unlocking state of the lock device shown in FIG. 1.

In a state shown in FIG. 5, the latch 10 is disposed in the unlocking position, and the ratchet 11 is disposed in a releasing position. In this state, an entrance to the locking groove 20 in the latch 10 is disposed so as to overlap the cutout 30 in the base 14, and the striker 2 can enter the locking groove 20 through the cutout 30. The striker 2 which has entered the locking groove 20 comes into abutment with a side surface 20*a* of the locking groove 20 which is located deeper in the locking groove 20 in a direction in which the striker 2 enters to thereby rotate the latch 10 in a direction indicated by an arrow B. This moves the latch 10 to the locking position.

Figure 6:
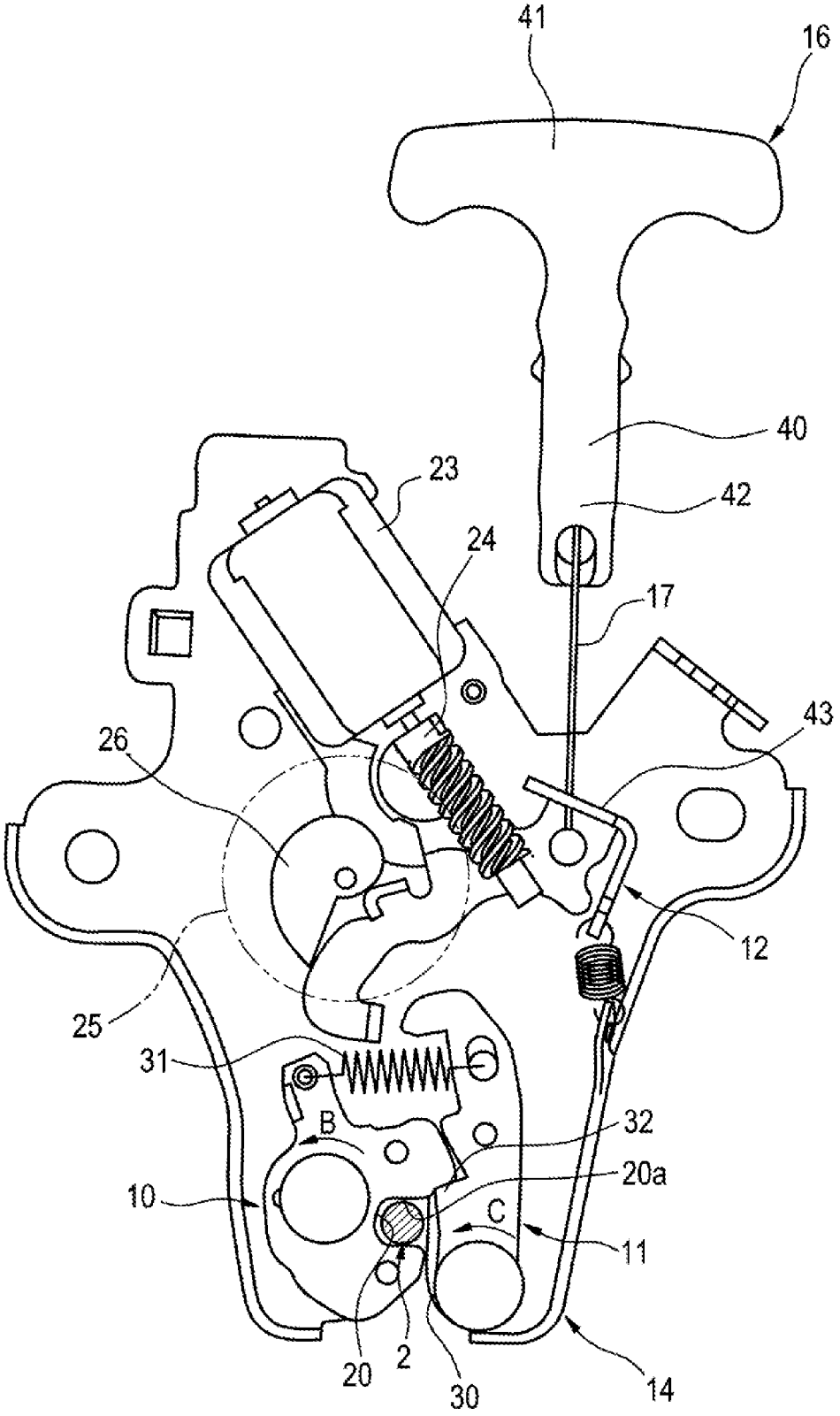
FIG. 6 A diagram showing a locking state of the lock device shown in FIG. 1.

As shown in FIG. 6, as the latch 10 moves to the locking position, the entrance to the locking groove 20 in the latch 10 moves away from the cutout 30 in the base 14 and is oriented towards the ratchet 11 which lies sideways relative to a direction in which the striker 2 enters the locking groove 20 and the cutout 30, whereby the striker 2 is prevented from being dislocated from the locking groove 20.

The latch 10 and the ratchet 11 are connected together by a spring 31, and as the latch 10 moves to the locking position, the ratchet 11 is pulled by the latch 10 via the spring 31 and is rotated in a direction indicated by an arrow C to be moved to the engaging position where the ratchet 11 locks the latch 10.

As the ratchet 11 moves to the engaging position, a locking portion 32 of the ratchet 11 enters the locking groove 20 which is oriented to face the ratchet 11 to be disposed so as to face the side surface 20*a*. This prevents the rotation of the latch 10 from the locking position towards the unlocking position, whereby the locking of the striker 2 by the latch 10 is held.

Figure 7:
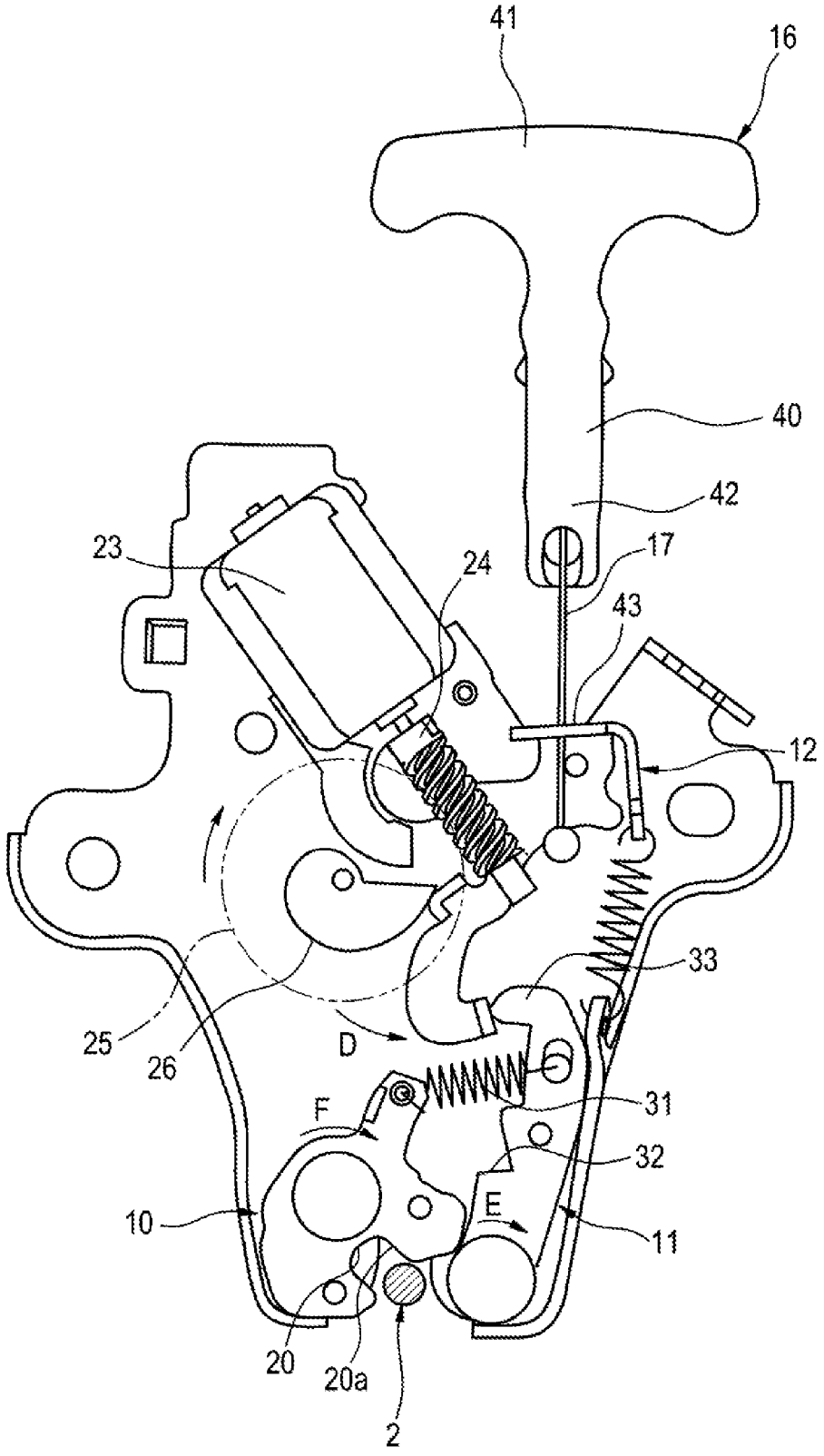
FIG. 7 A diagram showing an unlocking operation of the lock device shown in FIG. 1 with a motor in operation.

As shown in FIG. 7, when the motor 23 is driven with the latch 10 disposed in the locking position and the ratchet 11 disposed in the engaging position, the worm wheel 25 which meshes with the worm 24 of the motor 23 rotates, and the lever 12 which slides the cam 26 of the worm wheel 25 is rotated in a direction indicated by an arrow D. The lever 12 which is so rotated presses against a pressed portion 33 of the ratchet 11, and the ratchet 11 pressed against is rotated in a direction indicated by an arrow E so as to be moved from the engaging position to the releasing position.

As the ratchet 11 moves to the releasing position, the engagement of the locking portion 32 of the ratchet 11 with the side surface 20*a* of the locking groove 20 in the latch 10 is released, whereby the rotation of the latch 10 from the locking position to the unlocking position is permitted. Then, the latch 10 is pulled by the ratchet 11 via the spring 31 to be rotated in a direction indicated by an arrow F. This releases the locking of the striker 2 by the latch 10, whereby the locking of the trunk lid TL (refer to FIG. 1) by the lock device 1 is released.

Figure 8:
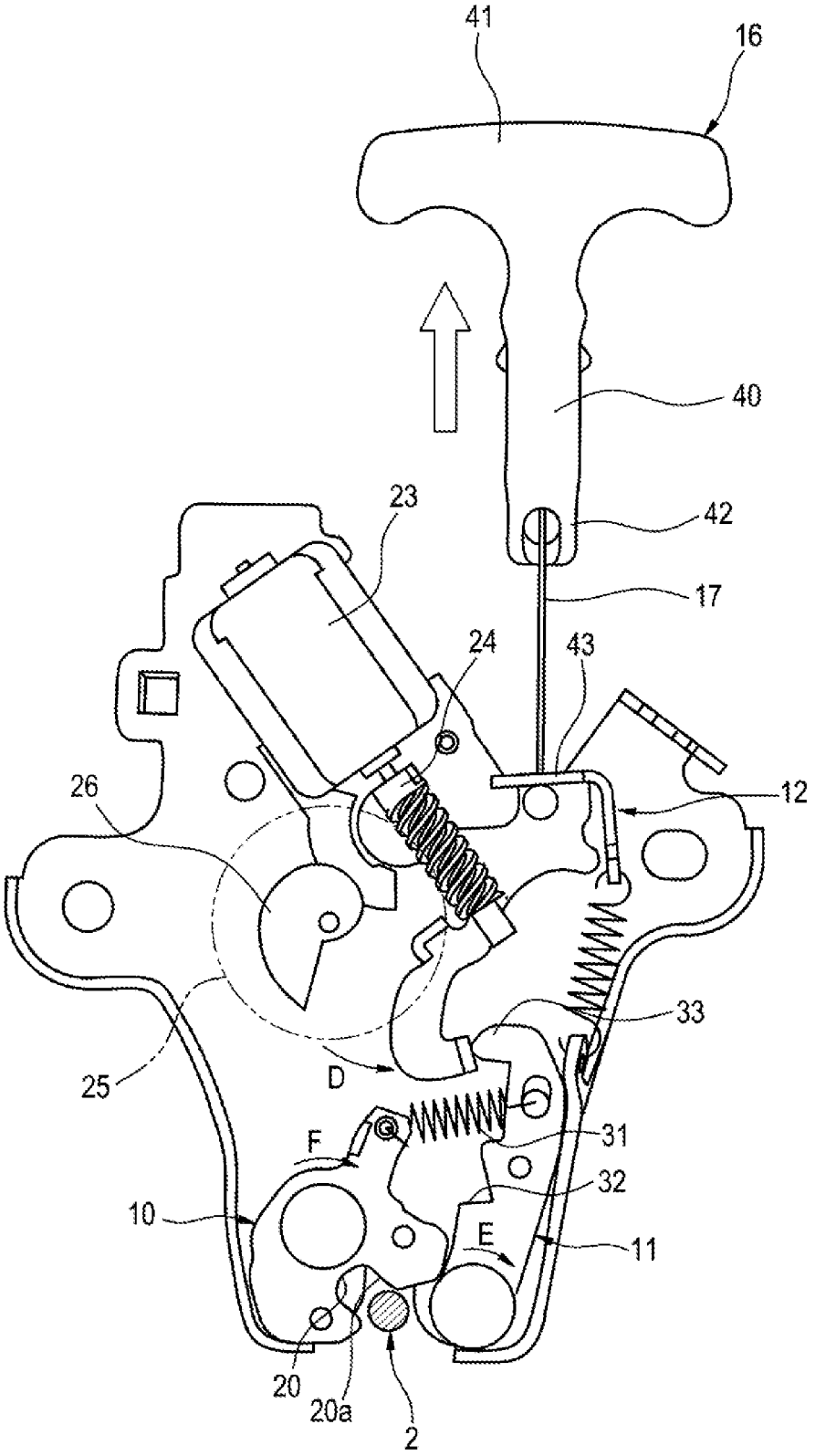
FIG. 8 A diagram showing an unlocking operation of the lock device shown in FIG. 1 with a handle in operation.

In the lock device 1 including the handle 16, as shown in FIG. 8, the lever 12 is allowed to be rotated in a direction indicated by the arrow D by pulling the handle 16.

The handle 16 is connected to the lever 12 via a wire 17 which is connected to a connecting portion 43 of the lever 12 at one end portion thereof and is disposed farther ahead in a direction in which the connecting portion 43 moves in a rotation of the lever 12 indicated by an arrow D and is disposed in such a state that the shaft 40 follows substantially along the direction in which the connecting portion 43 moves. As the handle 16 is pulled in the direction in which the shaft 40 extends, the connecting portion 43 to which the wire 17 is connected is pulled, whereby the lever 12 is rotated in the direction indicated by the arrow D.

The lever 12 which is rotated as a result of the handle 16 being pulled presses against the ratchet 11 and rotates the ratchet 11 in the direction indicated by the arrow E to move it from the engaging position to the releasing position as described above. Then, as the ratchet 11 moves to the releasing position, the locking of the striker 2 by the latch 10 is released, whereby the locking of the trunk lid TL (refer to FIG. 1) by the lock device 1 is released.

In this lock device 1, the attaching portion 44 where the handle 16 id detachably attached is provided integrally on the resin case 15. In the event of the handle 16 being provided as required, compared with a case where a metallic handle housing where the handle 16 is detachably attached is welded to the base 14 or a resin handle housing is locked on the base 14, the number of man-hours and cost required to build up the lock device 1 can be reduced.

The case 15 where the attaching portion 44 is provided integrally accommodates the actuator 13 between the base 14 and itself and is fixed to the base 14, and the case 15 is relatively large in size compared with the handle housing alone. Thus, the number of locations where the case 15 is fixed to the base 14 or the fixing area can be ensured over a wide range. This can restrict the attaching portion 44 and the handle 16 which is attached to the attaching portion 44 from falling off the case 15, thereby making it possible to enhance the reliability of the lock device 1.

Figure 9:
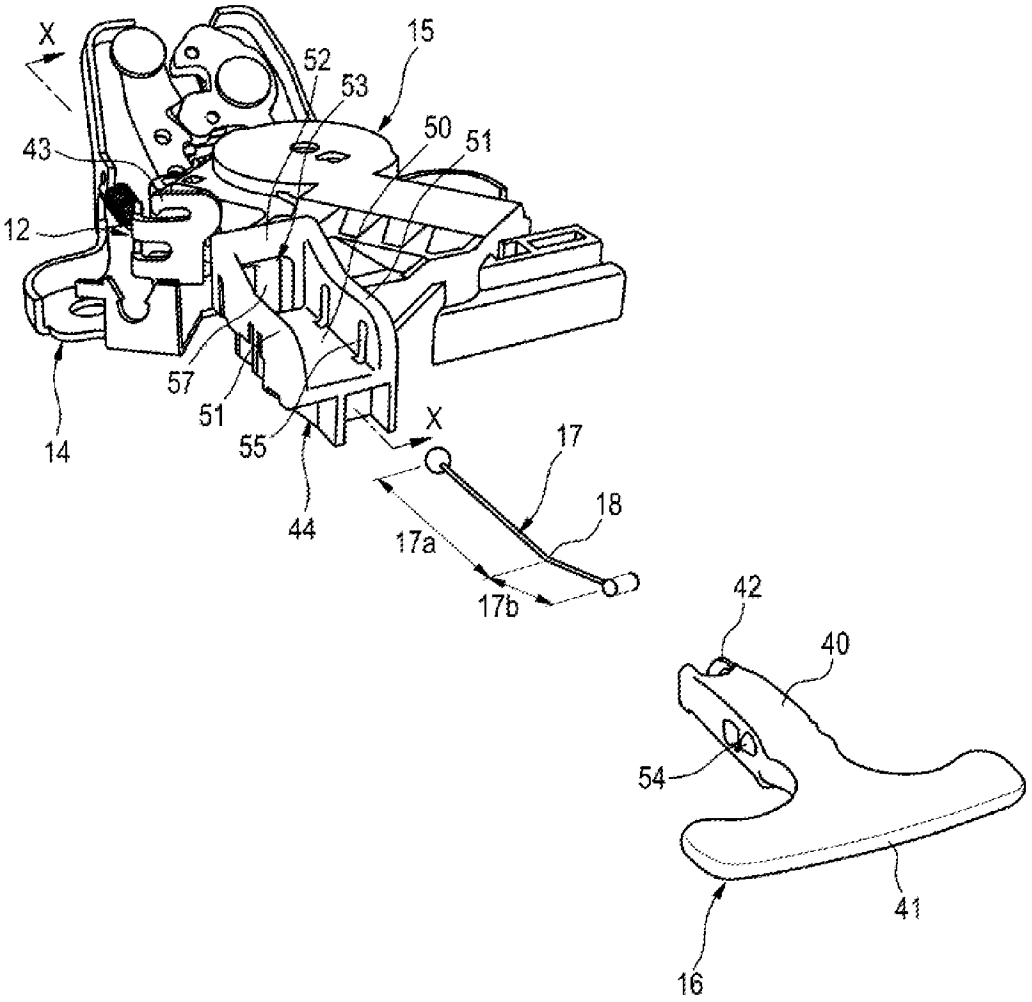
FIG. 9 A diagram showing the configurations of a handle and a handle attaching portion of the lock device shown in FIG. 1.

FIG. 9 shows the configurations of the handle 16 and the attaching portion 44 of the case 15 to which the handle 16 is attached, and FIG. 10 shows a section taken along a line X-X in FIG. 9. FIG. 11 shows the operation of the handle 16 when the handle 16 is operated.

The attaching portion 44 has a rear wall portion 50, a pair of side wall portions 51 and a front wall portion 52. The rear wall portion 50 extends along a placing surface 14*a* of the base 14 which is attached to an inner surface of the trunk lid TL. The pair of side wall portions 51 is provided to rise from both side edges of the rear wall portion 50. The front wall portion 52 configures an accommodating portion 53, into which a proximal end portion of the shaft 40 of the handle 16 is inserted together with the rear wall portion 50 and the pair of side wall portions 51.

An engaging projection 54 is provided on each side surface of the shaft 40 of the handle 16, and an engaging portion 55 in which the engaging projection 54 fits is provided in each of the pair of side wall portions 51 of the attaching portion 44. Additionally, a recessed hole 56 is provided at an end portion of the rear wall portion 50 configuring the accommodating portion 53, and the proximal end portion 42 of the shaft 40 inserted into the accommodating portion 53 enters into the recessed hole 56.

The wire 17 which connects the lever 12 with the handle 16 is inserted through a through hole 58 which is provided in a bottom wall portion 57 of the accommodating portion 53, and the one end portion of the wire 17 is connected to the connecting portion 43 of the lever 12, while the other end portion is connected to the proximal end portion 42 of the shaft 40 of the handle 16.

The wire 17 is made, for example, of a metallic material, and a bent portion 18 which is plastically deformed is provided at a longitudinal middle portion which is disposed near the through hole 58. A portion 17*b* which extends from the bent portion 18 as a boundary towards the handle 16 extends in such a way as to be inclined obliquely relative to a portion 17*a* which extends from the bent portion 18 towards the lever 12.

As shown in FIG. 10, the proximal end portion 42 of the shaft 40 is inserted into the accommodating portion 53, and the engaging projections 54 are fitted in the corresponding engaging portions 55 of side wall portions 51, whereby the handle 16 is attached to the attaching portion 44. The handle 16 is held to the attaching portion 44 with the shaft 40 following the placing surface 14*a* of the base 14.

With the handle 16 held to the attaching portion 44, the portion 17*b* of the wire 17 on the handle 16 side also extends along the placing surface 14*a* of the base 14, and the portion 17*a* of the wire 17 on the lever 12 side which continues to the portion 17*b* on the handle 16 side via the bent portion 18 is curved to project to an opposite side to the placing surface 14*a* of the base 14.

As shown in FIG. 11, when the handle 16 is operated, the engaging projections 54 are dislocated from the engaging portions 55 of the side wall portions 51 to thereby release the holding of the handle 16 by the attaching portion 44. When the holding of the handle 16 by the attaching portion 44 is released, the portion 17*a* on the lever 12 side which is being curved is restored into a straight line by means of the rigidity of the wire 17, and the portion 17*b* on the handle 16 side which continues to the portion 17*a* on the lever 12 side via the bent portion 18 rises.

As the portion 17*b* of the wire 17 which lies on the handle 16 side rises, the proximal end portion 42, to which the portion 17*b* on the handle 16 side is connected, enters into the recessed hole 56 in the accommodating portion 53, whereby the shaft 40 of the handle 16 is raised from the proximal end portion 42 as a fulcrum. This lifts up the grip portion 41 which is provided at a distal end portion of the shaft 40 from an inner surface of the trunk lid TL.

In this way, in the lock device 1 of this embodiment, the handle 16 is held to the attaching portion 44 in a first posture at normal times where the shaft 40 follows the placing surface 14*a* of the base 14, that is, the inner surface of the trunk lid TL. Then, when the handle 16 is operated, the handle 16 automatically shifts from the first posture to a second posture where the shaft 40 is raised from the proximal end portion 42 as the fulcrum, whereby the grip portion 41 is lifted up from the inner surface of the trunk lid TL. This can restrict the handle 16 from being brought into contact with an article or articles which are accommodated in the trunk lid at normal times and hence a malfunction of the handle 16 which would otherwise be caused to occur as a result of the contact of the handle 16 with the article or articles. When the handle 16 is operated, the operability of the handle 16 can be enhanced.

Although the handle 16 may be sprung up by the use of a spring or the like so that the handle 16 shifts from the first posture to the second posture, in this lock device 1, the handle 16 is caused to shift from the first posture to the second posture by means of the rigidity of the wire 17 which connects the lever 12 with the handle 16, whereby the number of constituent components of the lock device 1 is restricted from being increased, and the production cost of the lock device 1 can be reduced.

Thus, as has been described heretofore, the lock device disclosed in this description includes the latch which is moved between the locking position where the latch locks the striker and the unlocking position, the ratchet which is moved between the engaging position where the ratchet is brought into engagement with the latch which is moved to the locking position to prevent the latch from moving to the unlocking position and the releasing position where the ratchet releases the latch, the lever which moves the ratchet to the releasing position, the actuator which includes the motor which operates the lever, the base which supports the latch, the ratchet, the lever and the actuator, and the case which is fixed to the base and which accommodates at least the actuator between the base and itself, and the attaching portion where the operating member which is connected to the lever so as to enable the lever to be operated manually can be attached is provided integrally on the case.

In the lock device disclosed in this description, the operating member is attached to the attaching portion while being connected to the lever.

In the lock device disclosed in this description, the operating member is the handle which is pulled, and the grip portion is provided at the distal end portion of the shaft of the handle which extends in the direction in which the handle is pulled, while the proximal end portion of the shaft is connected to the lever. The attaching portion can hold the handle in the first posture in which the handle follows the placing surface of the base and can support the handle in the second posture in which the shaft rises from the proximal end portion as the fulcrum.

In the lock device disclosed in this description, the attaching portion has the accommodating portion into which the proximal end portion of the shaft is inserted, and the recessed hole, into which the proximal end portion of the shaft enters, is provided in the wall portion of the accommodating portion that is located on the placing surface side of the base.

In the lock device disclosed in this description, the handle is raised from the first posture to the second posture by means of the rigidity of the wire which connects the proximal end portion of the shaft with the lever.

While the invention has been described by reference to the specific embodiment, it is obvious to those skilled in the art to which the invention pertains that various alterations or modifications can be made to the embodiment without departing from the spirit and scope of the invention.

INDUSTRIAL APPLICABILITY

The invention can be applied not only to a lock device on a trunk lid of a closed-type trunk but also to a lock device on a trunk lid of an opening-type trunk (a luggage space) and is useful in such a case that the locking of the trunk lid cannot be released by operating a switch provided inside a passenger compartment although a battery of the vehicle is found to be flat or something wrong is occurring in the electric system which controls the motor 23.

REFERENCE NUMERALS AND SIGNS

1 lock device
2 striker
10 latch
11 ratchet
12 lever
13 actuator
14 base
14*a* placing surface
15 case
16 handle
17 wire
23 motor
40 shaft
41 grip portion
42 proximal end portion
44 attaching portion
53 accommodating portion
56 recessed hole

The invention claimed is:

1. A lock device comprising:

a latch that is movable between a locking position where the latch locks a striker and an unlocking position;

a ratchet that is movable between an engaging position where the ratchet is brought into engagement with the latch which is moved to the locking position to prevent the latch from moving to the unlocking position and a releasing position where the ratchet releases the latch;

a lever configured to move the ratchet to the releasing position;

an actuator comprising a motor for operating the lever;

a base that supports the latch, the ratchet, the lever and the actuator;

a body casing, which is fixed to the base, and which accommodates at least the actuator between the base and the body casing, wherein an attaching portion is provided integrally on and formed as a single piece with the body casing; and an operating member detachably attachable to the attaching portion and connected to the lever so as to enable the lever to be operated manually, wherein, when the operating member is operated, the operating member is transitioned from a first posture in which the operating member extends along a first direction, which is parallel to a placing surface of the base to a second posture in which the operating member is inclined in a direction relative to the placing surface of the base and is lifted up from an inner surface of a trunk lid, the operating member transitioned to the second posture being releasable from the attaching portion, wherein the attaching portion comprises an engagement portion configured to engage with the operating member at the first posture such that the operating member cannot be moved in the first direction while in the first posture, wherein the body casing, where the attaching portion is provided integrally, is configured to accommodate the actuator between the base and itself and is fixed to the base, wherein the operating member is a handle configured to be pulled in a direction, wherein a grip portion is provided at a distal end portion of a shaft of the handle extending in the direction in which the handle is pulled, and wherein a proximal end portion of the shaft is connected to the lever, wherein the attaching portion is configured to hold the handle in the first posture and to support the handle in the second posture in which the shaft rises from the proximal end portion as a fulcrum, and wherein the attaching portion comprises an accommodating portion into which the proximal end portion of the shaft is inserted, and wherein a recessed hole, into which the proximal end portion of the shaft enters, is provided in a wall portion of the accommodating portion that is located on a placing surface side of the base.

2. The lock device according to claim 1, wherein the operating member is connected to the lever and is attached to the attaching portion.

3. The lock device according to claim 1, wherein the handle is raised from the first posture to the second posture by the rigidity of a wire that connects the proximal end portion of the shaft with the lever.

4. The lock device according to claim 1, wherein:

the placing surface of the base is configured to attach to the inner surface of the trunk lid; and the attaching portion comprises a rear wall portion that extends along the placing surface, a pair of side wall portions, and a front wall portion.

5. The lock device according to claim 4, wherein the operating member comprises a shaft, and the front wall portion configures an accommodating portion configured to accommodate a proximal end portion of the shaft.

6. The lock device according to claim 5, wherein the shaft comprises a plurality of engaging portions, the side wall portions of the attaching portion comprise respective engaging portions, and the engaging portions of the shaft and the engaging portions of the side wall portions are configured to engage with each other.

7. A lock device comprising:

a latch that is movable between a locking position where the latch locks a striker and an unlocking position;

a ratchet that is movable between an engaging position where the ratchet is brought into engagement with the latch which is moved to the locking position to prevent the latch from moving to the unlocking position and a releasing position where the ratchet releases the latch;

a lever configured to move the ratchet to the releasing position;

an actuator comprising a motor for operating the lever;

a base that supports the latch, the ratchet, the lever and the actuator;

a body casing, which is fixed to the base, and which accommodates at least the actuator between the base and the body casing, wherein an attaching portion is provided integrally on and formed as a single piece with the body casing; and an operating member detachably attachable to the attaching portion and connected to the lever so as to enable the lever to be operated manually, wherein, when the operating member is operated, the operating member is rotated from a first posture in which the operating member extends along a first direction, which is parallel to a placing surface of the base to a second posture in which the operating member is rotated in a direction away from the placing surface of the base and is lifted up from an inner surface of a trunk lid, wherein the attaching portion comprises an engagement portion configured to engage with the operating member at the first posture such that the operating member cannot be moved in the first direction while in the first posture, wherein the operating member, when rotated to the second posture, is disengaged from the engagement portion and is releasable from the attaching portion, wherein the body casing, where the attaching portion is provided integrally, is configured to accommodate the actuator between the base and itself and is fixed to the base, and wherein the operating member comprises:

a shaft; and a grip portion provided at a distal end portion of the shaft, a proximal end portion of the shaft being connected to the lever, wherein the attaching portion comprises an accommodating portion configured to receive the proximal end portion of the shaft, and wherein the accommodating portion has a recessed hole extending in a direction orthogonal to the placing surface.

8. The lock device according to claim 7, wherein in the case the operating member is rotated from the first posture to the second posture, the proximal end portion of the shaft enters into the recessed hole, and the shaft is raised from the proximal end portion as a fulcrum.

9. The lock device according to claim 3, wherein for the second posture, a first portion of the wire extends along the placing surface of the base, while a second portion of the wire inclined obliquely relative to the placing surface of the base.

10. A lock device comprising:

a latch that is movable between a locking position where the latch locks a striker and an unlocking position;

a ratchet that is movable between an engaging position where the ratchet is brought into engagement with the latch which is moved to the locking position to prevent the latch from moving to the unlocking position and a releasing position where the ratchet releases the latch;

a lever configured to move the ratchet to the releasing position;

an actuator comprising a motor for operating the lever;

a base that supports the latch, the ratchet, the lever and the actuator;

a body casing, which is fixed to the base, and which accommodates at least the actuator between the base and the body casing, wherein an attaching portion is provided integrally on and formed as a single piece with the body casing; and an operating member detachably attachable to the attaching portion and connected to the lever so as to enable the lever to be operated manually, wherein, when the operating member is operated, the operating member is transitioned from a first posture in which the operating member extends along a first direction, which is parallel to a placing surface of the base to a second posture in which the operating member is inclined in a direction relative to the placing surface of the base and is lifted up from an inner surface of a trunk lid, the operating member transitioned to the second posture being releasable from the attaching portion, wherein the attaching portion comprises an engagement portion configured to engage with the operating member at the first posture such that the operating member cannot be moved in the first direction while in the first posture, wherein the body casing, where the attaching portion is provided integrally, is configured to accommodate the actuator between the base and itself and is fixed to the base, the placing surface of the base is configured to attach to the inner surface of the trunk lid; and the attaching portion comprises a rear wall portion that extends along the placing surface, a pair of side wall portions, and a front wall portion, and wherein the operating member comprises a shaft, and the front wall portion configures an accommodating portion configured to accommodate a proximal end portion of the shaft.

11. The lock device according to claim 10, wherein the operating member is connected to the lever and is attached to the attaching portion.

12. The lock device according to claim 10, wherein the operating member is raised from the first posture to the second posture by the rigidity of a wire that connects the proximal end portion of the shaft with the lever.

13. The lock device according to claim 10, wherein the shaft comprises a plurality of engaging portions, the side wall portions of the attaching portion comprise respective engaging portions, and the engaging portions of the shaft and the engaging portions of the side wall portions are configured to engage with each other.

14. The lock device according to claim 12, wherein for the second posture, a first portion of the wire extends along the placing surface of the base, while a second portion of the wire inclined obliquely relative to the placing surface of the base.

* * * * *